United States Patent [19]

Uhl

[11] Patent Number: 4,971,090

[45] Date of Patent: Nov. 20, 1990

[54] SUPPORT MEANS FOR FOLDABLE STRUCTURE

[76] Inventor: Michael Uhl, 829 Myrna Dr., West Hempstead, N.Y. 11552

[21] Appl. No.: 410,303

[22] Filed: Sep. 21, 1989

[51] Int. Cl.[5] ..... E04H 15/28

[52] U.S. Cl. ..... 135/98; 135/99; 135/107; 403/170

[58] Field of Search ..... 135/98, 99, 104, 107, 135/20 R, 36 R; 403/170, 171, 176

[56] References Cited

U.S. PATENT DOCUMENTS

| | | | |
|---|---|---|---|
| 2,953,145 | 9/1960 | Moss et al. | 135/98 |
| 3,684,028 | 8/1972 | Crawford | 403/171 X |
| 3,724,473 | 4/1973 | Moss | 135/98 X |
| 3,768,494 | 10/1973 | Weber | 135/20 R |
| 3,929,146 | 12/1975 | Maiken | 135/98 |
| 4,133,341 | 1/1979 | Shaheen | 135/99 |
| 4,637,748 | 1/1987 | Beavers | 135/98 X |
| 4,750,509 | 6/1988 | Kim | 135/98 X |
| 4,834,126 | 5/1989 | Sweet, Jr. | 135/20 R X |

FOREIGN PATENT DOCUMENTS

| | | | |
|---|---|---|---|
| 2729427 | 1/1979 | Fed. Rep. of Germany | 135/98 |

*Primary Examiner*—Richard E. Chiloot, Jr.
*Assistant Examiner*—Lan Mai
*Attorney, Agent, or Firm*—Bauer & Schaffer

[57] ABSTRACT

Support means for foldable structures of the type having a roof of foldable material and a vertical mounting shaft staking perpendicularly to the ground. The interlocking support means consists of upper and lower interlocking members. A plurality of horizontal ribs are pivoted and clamped in the interlocking support means so that the ribs are held horizontally, but can fold down along the vertical shaft for transportation. The ribs have a channel cross-section. A rope extends from the end of one rib through the rib channel, through the interlocking mounting means and then through a second rib, whereby the ends of the rope may be used to stake down the structure and support side walls.

10 Claims, 4 Drawing Sheets

18A
14
5A
13
28A
18B
10
9
31A
19
19
29A
15
15
12
18A
30A
7
8
11
6A
5B
16
19A
6B
6A

SUPPORT MEANS FOR FOLDABLE STRUCTURE

TECHNICAL FIELD

This invention relates to support means for foldable structures and more particularly, to support means for foldable structures having a minimum length when folded up for transportation with minimum wind resistance and maximum shelter capacity.

BACKGROUND

Foldable structures, such as umbrellas and tents, are quite common. A problem with these, especially the umbrella types, is that they require too much space to stow and transport and are difficult to stow in a car with umbrella capacity for two or more people.

PRIOR ART

Prior art is shown by the following U.S. Pat. Nos.: 2,953,145; 3,724,473; 4,133,341; 4,637,748 and 4,750,509.

None of these references show foldable structures like the present invention which can fold into a minimum length for storage during transportation with maximum ease of assembly.

Also, this invention has a flat roof which allows for minimal wind resistance and uniform head room underneath the roof.

THE INVENTION

Support means for foldable structures of the type having a roof of foldable material and a vertical mounting shaft. Interlocking support means are mounted on top of the vertical shaft. The interlocking support means consists of upper and lower interlocking members. A plurality of horizontal ribs are hinged and clamped in the interlocking support means so that the ribs are held horizontally, but can fold down along the vertical shaft for transportation. The ribs have a channel cross-section. Ropes extend from the end of one rib through the rib channel, through the interlocking mounting means and then through a second rib, whereby the ends of the rope may be used to stake down the structure, and which support the side wall.

OBJECTS OF THE INTERVENTION

A principal object of the invention is to provide new and improved foldable structures means with minimum folded length with maximum shelter capacity.

Another object of the invention is to provide new and improved foldable structure means having a vertical mounting shaft and interlocking support means mounted on top of the vertical shaft for clamping and supporting horizontal rib members which support the flat foldable roof.

Another object of the invention is to provide new and improved foldable structure means having a vertical mounting shaft and interlocking support means mounted on top of the vertical shaft for clamping and supporting horizontal rib members which support the foldable roof, wherein the ribs have a channel cross-section, and a rope extending from the end of one rib to the rib channel, through the interlocking mounting means and then through a second rib, whereby the ends of the rope may be used to stake down the structure, and gives form to sidewalls.

These and other objects of the invention will be apparent from the following specifications and drawings of which:

BEST MODE OF THE INVENTION

Figure 1:
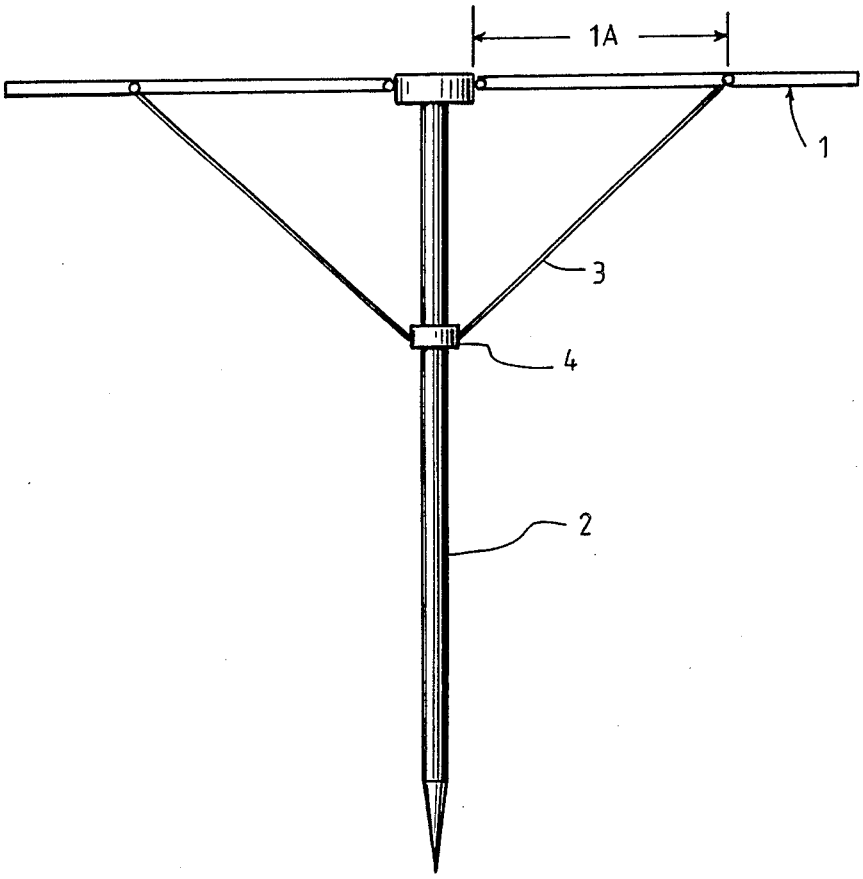
Fig. 1 (PRIOR ART)
FIG. 1 is a side diagramatic view of prior art of the umbrella type.

Referring to the drawings, FIG. 1 shows prior art of the umbrella type. In this umbrella type structure, ribs 1, etc., extend radially from the top of the center shaft 2, and are held in open position by means of ribs 3, which are pivotally mounted on a slidable member 4, which locks the ribs 1 in open position. When the umbrella structure is folded, the minimum folded length is the sum total of dimensions 1A and 3. When the present invention is folded, the maximum length is equal to the dimension of rib 1A, which is the telescoped length of the horizontal ribs when fully telescoped into their shortest length.

Therefore, in comparison with the umbrella type device, the ribs 3 of the umbrella device are eliminated so that the maximum folded length of the present invention is to the dimension of rib 1A.

Figure 2:
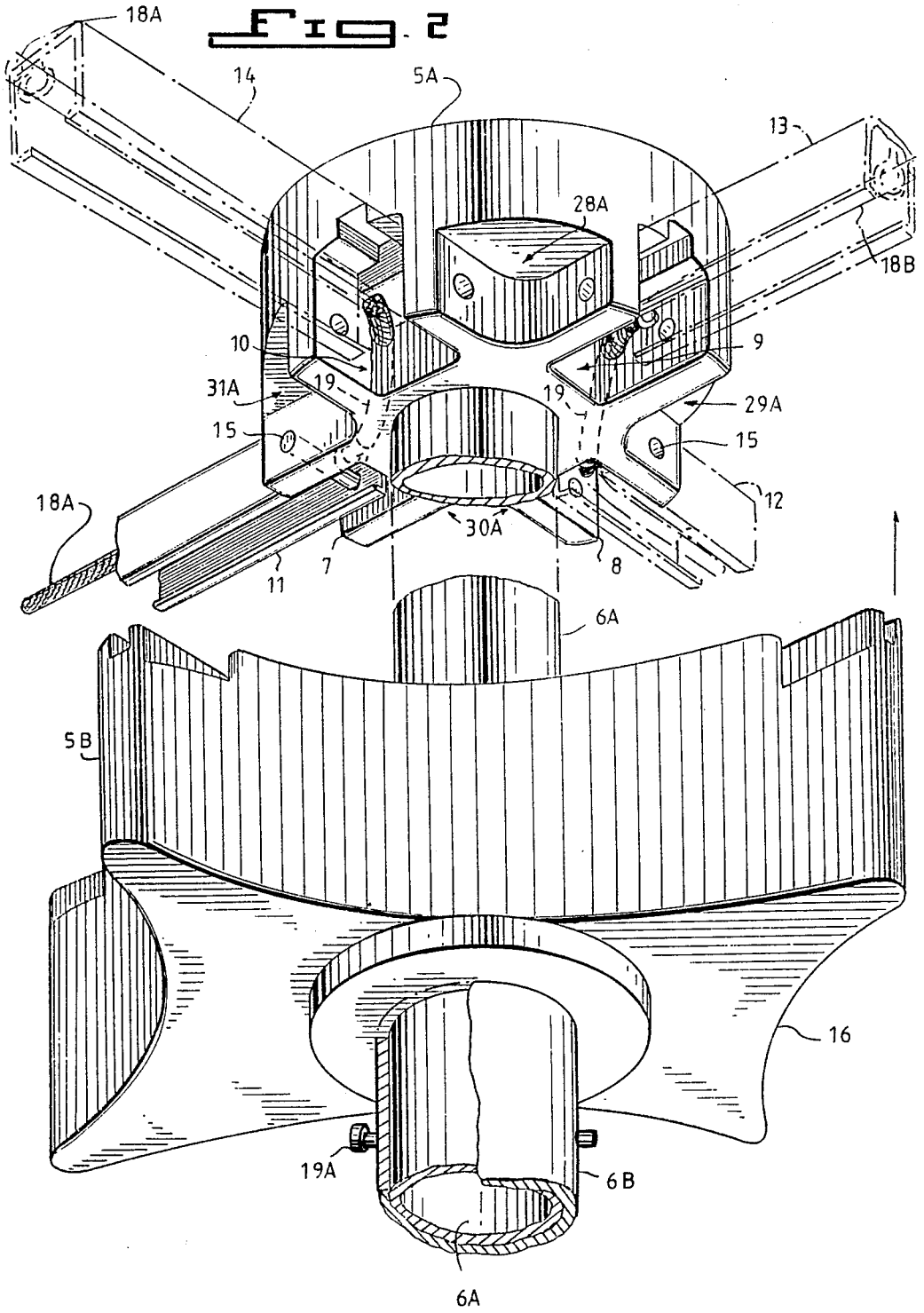
FIG. 2 is a perspective exploded view of the interlocking clamping members, detailing the bottom view of the upper interlocking member.

FIG. 2 is a three dimensional view of both upper interlocking member 5A and lower interlocking member 5B, detailing the bottom view of upper member 5A. Interlocking member 5A is stationary at the top of vertical shaft 6A. Shaft 6A is perpendicularly staked to the ground. Shaft 6A is also telescoped for minimum length when storing. The upper interlocking clamping member 5A has a plurality of channels 7,8,9, and 10, which house a plurality of inverted "U" shaped ribs 11,12,13, and 14. Use is made of this shape to pass a rope 18A through rib 14 into channel 10, through rope tunnel 19, out of channel 7 and through rib 11. Therefore, the free ends of rope 18A may be used to stake down the structure and form the side walls. The same would be said for rope 18B and ribs 12 and 13.

Ribs 11,12,13, and 14 are pivoted on the axes 15, so they can fold down into recesses 16 of lower member 5B, when the member 5B, is slid down shaft 6A, and rotated, for the storage mode.

During operational mode, ribs, 11,12,13, and 14, are pivoted horizontally in clamping member 5A, and interlocked in that position by the lower member 5B, in a friction fit.

Figure 3:
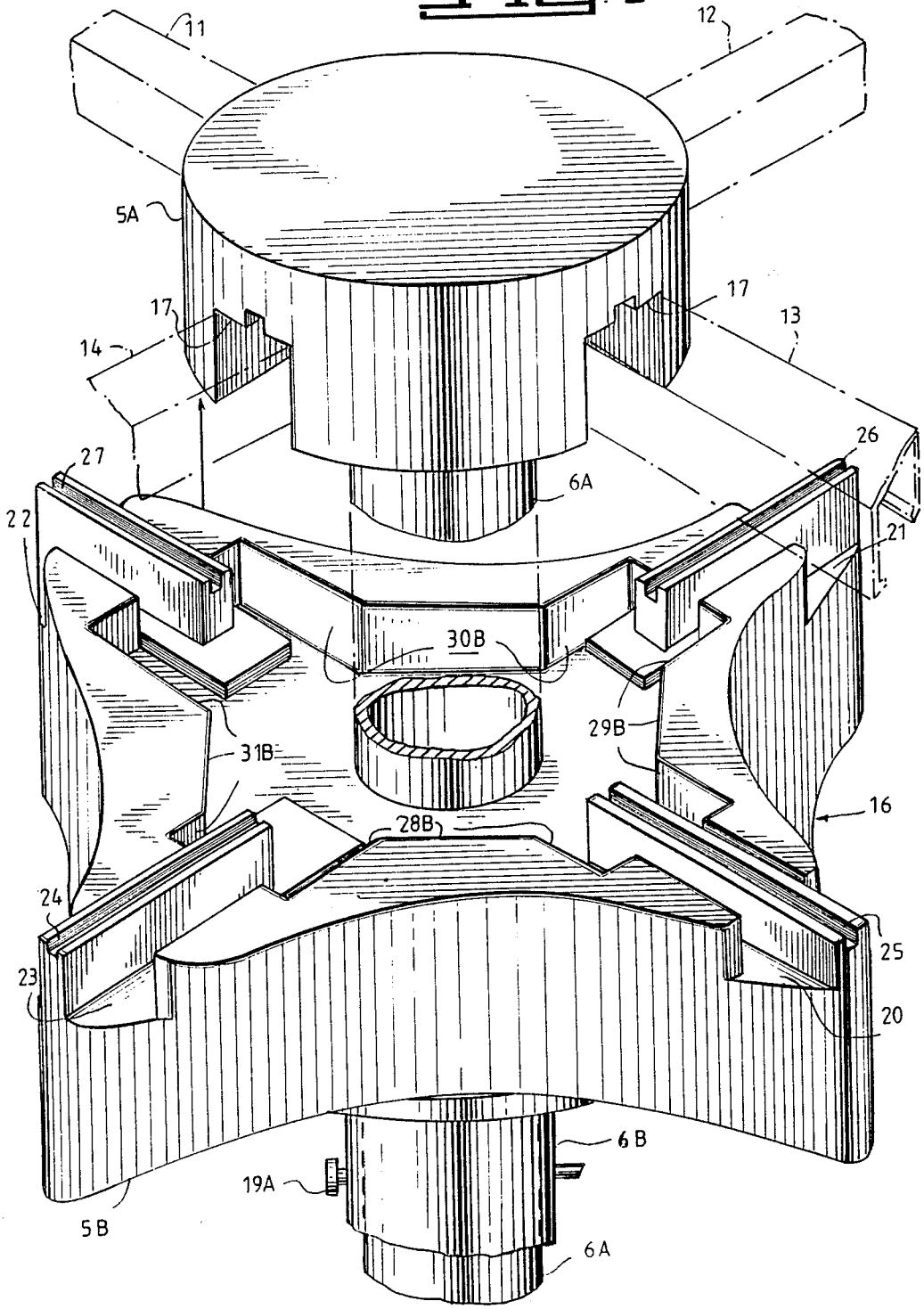
FIG. 3 is a perspective exploded view of the interlocking clamping members, detailing the top view of the lower interlocking member.

FIG. 3 is a three dimensional view of both upper interlocking member 5A and lower interlocking member 5B, detailing the top view of the lower member 5B. Member 5B, is stationary on shaft 6B, which is slidably mounted on shaft 6A, for the function of opening and closing of the foldable structure. When the structure is in the opened position and members 5A and 5B are interlocked, locking pin 19A extends through both shafts 6A and 6B to secure the friction fit in place. Interlocking member 5B has a plurality of radically extending ribs supports 20,21,22, and 23, which receive and support ribs 11,12,13, and 14. Rope channels 24,25,26, and 27, allow for ropes 18A and 18B to pass on through the inverted "U" shaped ribs 11,12,13, and 14, therefore allowing the free ends of rope 18A and 18B to stake down the structure and give form to the side walls.

FIG. 3, member 5A, shows rib barriers 17, which do not allow ribs 11,12,13, and 14, to hyperextend upwards beyond member 5A.

Referring to both FIGS. 2 and 3, FIG. 2, member 5A inner wall cutouts 28A, 29A, 30A, and 21A, have friction fits with FIG. 3, member 5B, inner wall cutouts 28B, 29B, 30B, and 31B, for additional strength in interlocking both members 5A and 5B.

Figure 4:
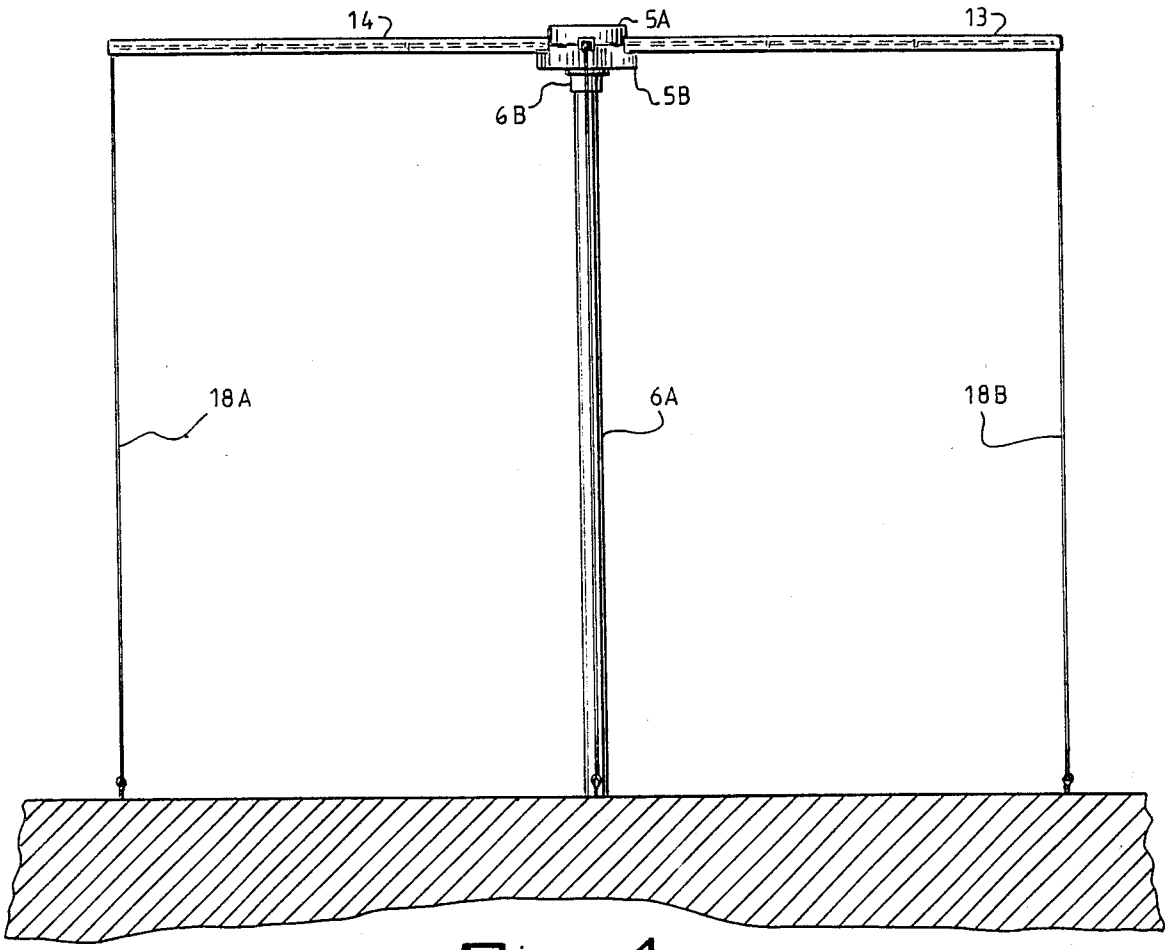
FIG. 4 is a side view of an open umbrella embodying the present invention.

In the open umbrella, as seen in FIG. 4, the movable hub 6B is raised so that ribs 11, 12, 13, and 14 are horizontal and the interlocking members 5A and 5B are fully engaged. Thereby the ribs extend horizontally, and the shaft 6A may be staked vertically. The guide ropes 18A and 18B can then be staked to the ground via any conventional pin means available.

What is claimed:

1. A foldable umbrella structure comprising a collapsible canopy supported by an articulated frame, said frame comprising a vertically oriented shaft having a stationary hub fixed at its upper end and a moveable hub slidably axially and rotatable thereon relative to the stationary hub, a plurality of elongated ribs pivotally mounted at one end to said stationary hub for movement between a collapsed position in which said ribs are parallel to said shaft and an open position in which said ribs extend horizontally substantially perpendicular to said shaft, said slidable hub being releasably securable in engagement with said fixed hub to clamp said ribs therebetween when in said open position and maintain said ribs in cantilevered extension from said shaft.

2. The foldable umbrella structure according to claim 1, wherein said stationary and movable hubs are cooperatively shaped to radially provide interlocking channels for said ribs, said channels having surfaces engaging with each other to secure said ribs against lateral movement and maintain said ribs in fixed horizontal position.

3. The foldable umbrella structure according to claim 2, wherein said ribs comprise a pair of telescoping arms whereby the horizontal extend from said shaft may be adjusted.

4. The foldable umbrella structure according to claim 3, wherein said ribs are formed of a U-shaped channel and are pivotally mounted in inverted arrangement in said stationary hub, said slidable hub having upward extending barrier adapted to fit into said channel respectively to prevent lateral movement of said ribs.

5. The foldable umbrella structure according to claim 4, including at least one continuous rope, said rope being passed through said fixed hub and selected pairs of extending ribs whereby the free ends thereof may be staked to provide support vertical walls about the periphery defined by the free ends of said ribs.

6. The foldable umbrella structure according to claim 1, wherein said moveable hub is formed with a cavity on its upper surface for receiving said fixed hub, said stationary hub informed with a plurality of uniformly spaced channels each forming a recess for receiving the pivotable end of an elongated rib and said movable hub is shaped to provide correspondingly spaced rib supports adapted to underlie said ribs in each said recess when interlocked with said fixed hub and when said movable hub is displaced rotatably and axially from engagement with said fixed hub to permit said ribs to fall parallel to said shaft.

7. The foldable umbrella structure according to claim 5, wherein said stationary hub and movable hub are male and female interlocking members respectively and the stationary hub is formed with mortices providing the recess for said ribs and said movable hub is provided with tenons engaging said ribs and interlocking with said motors respectively.

8. The foldable umbrella structure according to claim 7, wherein said arms are hollow and the rope passes through the arms of each pair outwardly of the horizontally free ends of said arms.

9. A foldable structure for forming umbrellas, tents, and the like, comprising a vertical shaft having a plurality of arms pivotally mounted at one end to the top of said shaft and being releasably secured in a horizontally extending position, a continuous rope passing from one of a pair of selected arms to the other of the pair and passing from the free ends of each of the arms in the pair, the free ends of said rope extending from said arms and being secured to the ground whereby said rope aids in staking said structure and define peripheral walls therefor.

10. The foldable umbrella structure according to claim 9, wherein said arms are pivotably mounted on a hub fixed to the end of said shaft and said rope passes through said hub on passing from one of said paired arms to the other.

* * * * *

UNITED STATES PATENT AND TRADEMARK OFFICE

CERTIFICATE OF CORRECTION

PATENT NO. : 4,971,090

DATED : November 20, 1990

INVENTOR(S) : MICHAEL UHL

It is certified that error appears in the above-identified patent and that said Letters Patent is hereby corrected as shown below:

Column 3, line 30 "slidable" should be --movable--
line 43 "extend" should be --extent--

Column 4, line 7 insert --for-- between "support" and --vertical-- line 27 "motors" should be --mortices--

Signed and Sealed this

Sixth Day of August, 1991

*Attest:*

*Attesting Officer*

HARRY F. MANBECK, JR.

*Commissioner of Patents and Trademarks*